United States Patent [19]

Guery et al.

[11] Patent Number: 4,596,911

[45] Date of Patent: Jun. 24, 1986

[54] COMBINED DEVICE FOR ON-LOAD BREAKING AND VISIBLE ISOLATION OF AN ELECTRIC CIRCUIT

[75] Inventors: Jean Guery, Bezons; André Zwarycz, Rueil Malmaison, both of France

[73] Assignee: La Telemecanique Electrique, France

[21] Appl. No.: 713,950

[22] Filed: Mar. 20, 1985

[30] Foreign Application Priority Data

Mar. 20, 1984 [FR] France ..... 84 04261

[51] Int. Cl.[4] ..... H01H 33/06; H01H 9/32

[52] U.S. Cl. ..... 200/151; 200/144 R; 200/146 R

[58] Field of Search ..... 200/146 R, 144 R, 146 A, 200/146 AA, 151

[56] References Cited

U.S. PATENT DOCUMENTS

| | | | |
|---|---|---|---|
| 1,473,574 | 11/1923 | Getchell | 200/151 |
| 1,833,173 | 11/1931 | Murray | 200/151 |
| 2,668,891 | 2/1954 | Driescher, Jr. | 200/151 |

FOREIGN PATENT DOCUMENTS

| | | | |
|---|---|---|---|
| 1804661 | 6/1970 | Fed. Rep. of Germany | 200/146 R |
| 1282733 | 12/1961 | France | 200/151 |
| 0142621 | 7/1980 | German Democratic Rep. | 200/146 R |

*Primary Examiner*—Robert S. Macon

*Attorney, Agent, or Firm*—William A. Drucker

[57] ABSTRACT

A combined isolating switch-circuit breaker comprising at least one fixed contact breaking element, one fixed isolating contact element and at least one mobile assembly comprising a mobile contact breaking element electrically connected to a mobile isolating contact element. The arrangement of said mobile contact elements with respect to said fixed contact elements is provided so that, during closure of the combined device, the fixed isolating contact is closed before the electric contact is established between the fixed contact breaking element and the mobile contact breaking element and, conversely opening of the breaking contact is provided before opening of the isolating contact occurs.

22 Claims, 10 Drawing Figures a < b

COMBINED DEVICE FOR ON-LOAD BREAKING AND VISIBLE ISOLATION OF AN ELECTRIC CIRCUIT

BACKGROUND OF THE INVENTION

1. Field of the Invention

The present invention relates to a combined isolating switch-circuit breaker for on-load breaking and isolation of an electric circuit which, generally, will have to be with visible contact opening.

2. Description of the Prior Art

Generally, it is known that the isolation of an electric installation must guarantee total isolation thereof from the power supply source. Therefore, standardization prohibits the use of switches (which make the current and break it on load) as isolating switch members, even if the break is visible. This prohibition is due to the fact that the material opening of a contact circuit for breaking the current does not guard against the loss of insulation due to pollution of the insulators of the contact circuit by the electric arc which occurs at the moment of breaking.

Thus, any installation must associate with the circuit breaker (manual or automatic) a specific device ensuring the isolating function such for example an isolating switch, an isolating fuse holder, isolating terminals, etc. . .

This addition of an isolating switch therefore increases the complexity of the installation and increases its cost.

The purpose of the invention is therefore more particularly to associate in the same apparatus the circuit breaking and isolating functions.

A combined isolating switch-circuit breaker has already been proposed to this end of the type comprising at least one fixed contact breaker element, one fixed isolating contact element, at least one mobile assembly comprising a mobile breaking contact element connected electrically to a mobile isolating contact element, these two mobile contact elements being adapted for cooperating respectively with the two fixed contact elements and means for moving the mobile assembly between an open position in which the fixed contact elements are separated from the mobile contact elements and a closed position in which the fixed contact elements are in electrical contact with the corresponding mobile contact elements. In such a combined isolating switch-contact breaker, the arrangement of the mobile contact elements with respect to the fixed contact elements as well as the nature of the movements of the mobile assembly are adapted so that, when passing from the open to the closed position, the fixed isolating contact element is electrically connected to the mobile isolating contact element before the electric contact is established between the fixed breaking element and the mobile contact breaking element and, conversely, when passing from the closed to the open position, the fixed breaking contact element is separated from the mobile contact breaking element before disconnection of the fixed isolating contact element and the mobile isolating contact element.

However, in this type of combined device, so that the isolating function is not polluted by the breaking arc, it is necessary to provide appropriate arrangements so that the travel of the mobile assembly between the point where the fixed and mobile contact breaking elements separate mechanically and the point where the isolating contact elements separate mechanically is as large as possible.

Such an arrangement in fact guarantees that, on opening of the isolating contacts, the combined device does not have the current flowing therethrough.

In practice, however, this solution has a number of drawbacks. It involves more especially, in order to obtain a sufficiently long opening travel path, with, in addition, good insulating properties between the breaking and isolating contacts:

combined devices having a relatively space consuming structure;

the use of relatively complex kinematic drive chain (because of the length of the travel path).

The aim of the invention is therefore to overcome these drawbacks. For this, it provides an arrangement for significantly reducing the travel path of the mobile assembly without for all that increasing the risk of pollution of the isolating contacts, so as to make it possible to construct combined devices of reduced size and so less costly and less space consuming, which may be actuated by simple drive mechanisms.

SUMMARY OF THE INVENTION

To arrive at this result it provides a combined device of the above type comprising means for inserting an insulating screen between the mobile and fixed contact breaking elements, in the moment following the mechanical separation of these contact elements, these insertion means comprising a setting member with accumulation of potential energy, adapted for moving the screen from the passage zone of the mobile breaking contact element during the closure travel of the mobile assembly with, simultaneously, accumulation of potential energy and tripping means adapted for releasing this potential energy during the opening travel of the mobile assembly, when said separation occurs, so as to provide said insertion at a speed independent of that of the mobile assembly.

This arrangement, which guarantees that the breaking arc is extinguished before the isolating contact elements open, thus considerably reduces the travel path of the mobile assembly of the combined device.

BRIEF DESCRIPTION OF THE DRAWINGS

Embodiments of the invention will be described hereafter, by way of non limitative examples with reference to the accompanying drawings in which.

DESCRIPTION OF THE PREFERRED EMBODIMENTS

Figure 1:
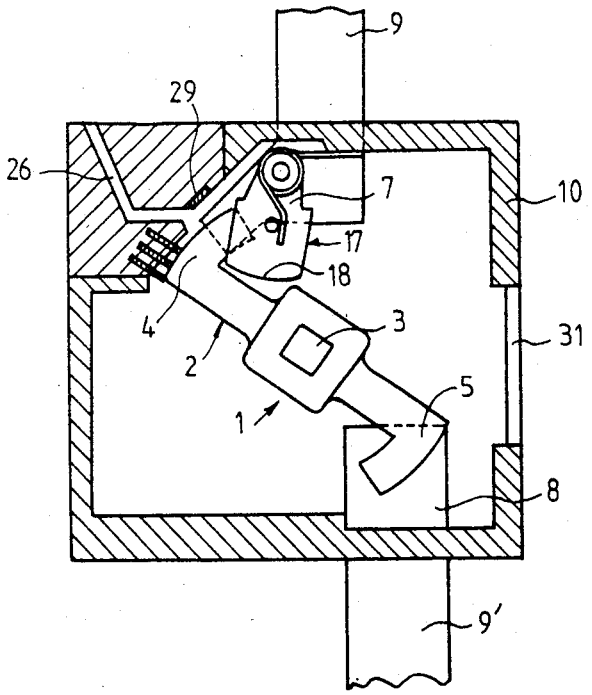
FIGS. 1 and 2 are two schematical views of a combined isolating switch-circuit breaker, in the closed position (FIG. 1) and in the open position (FIG. 2)
Figure 2:
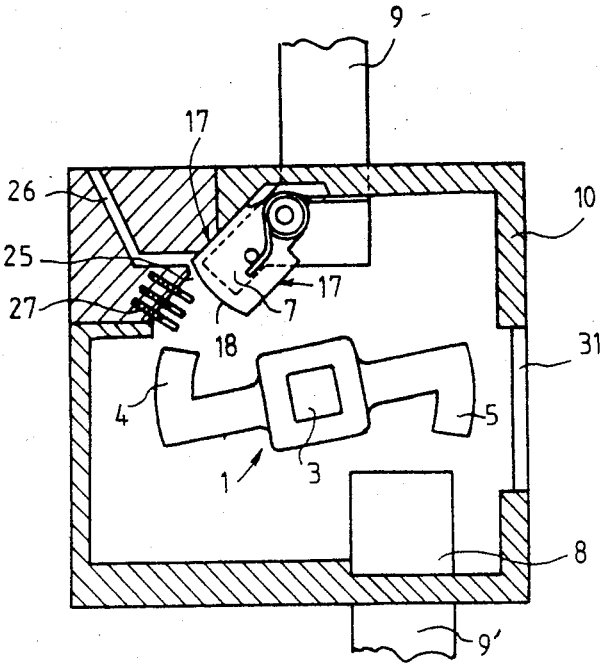

In the example shown in FIGS. 1 and 2, the combined isolating switch-circuit breaker comprises a rotary contact-carrying mobile assembly 1 formed by a conducting blade 2 mounted at its central portion on a transverse drive shaft 3 and having at its ends two respective curved jaws 4, 5 orientated in opposite directions with respect to each other and extending concentrically on each side of said blade 2.

This mobile assembly 1 is disposed inside a case 10, the drive shaft 3 extending along the longitudinal axis of this case 10 and being mounted for rotation on bearings not shown.

The fixed contact elements used in this example consist of two contact knives 7, 8 mounted respectively on two opposite inner walls of case 10 at positions substantially offset with respect to each other. These two contact knives 7, 8 extend inside case 10 in the plane of blade 2, as far as the passage zone of jaws 4, 5 and they are further connected to respective current leadins 9, 9′ passing through the walls of case 10.

More precisely, jaws 4, 5 are each formed from two plates 12, 13 (FIG. 6) substantially parallel, movable with respect to each other and urged towards each other by a resilient means such as a resilient chip 14.

At rest, the spacing between these two plates 12, 13 is less than the thickness of the contact knives 7, 8. Thus, during closure of the contact, the contact knife 7, 8 is forcibly inserted between the two plates 12, 13 and moves them apart under the action of the resilient clip 14, which then provides the contact force in the closed state.

It so happens that in this type of contact the electrodynamic compensation (during accidental overloads such as short circuits) advantageously tends to increase the contact making force.

Of course, the invention is not limited to this embodiment alone of mobile assembly 1. A simpler solution could consist in using, instead of a plate, two resilient conducting blades 15, 16 (FIG. 6) clamped together in their central portion. However, such an embodiment is only possible when the instantaneous overloads do not risk compromising the resilience and so the quality of the contact pressure exerted on the contact knives 7, 8.

The offset provided between the contact knives 7, 8 and their difference in length clearly show the separation of the electric functions provided by the combined isolating switch-circuit breaker. Thus, jaw 4 and the contact knife 7 cooperate for breaking the circuit, whereas jaw 5 and contact knife 8 ensure the isolating function.

In FIG. 2, which shows the combined isolating switch-circuit breaker in the open state, it can be clearly seen that the opening distance between jaw 4 and the contact knife 7 is much greater than the opening distance separating jaw 5 from contact knife 8.

With this arrangement:

during closure, engagement of knife 8 in jaw 5 (isolating contact) takes place before contact knife 7 is engaged in jaw 4 (breaking contact), and on opening, the mechanical separation of jaw 5 and contact knife 8 (isolation) only takes place when the electric break between the jaw 4 and contact knife 7 has been effected.

This staggering in time between the breaking and isolating functions of course depends on the arrangement of the contact elements and on the slowness of the rotational drive of mobile assembly 1 proper to this device. However, it also depends on the breaking speed of the breaking contact formed by jaw 4 and contact knife 7.

This is why, in order to increase this staggering in time and thus to increase the safety of the device, the invention proposes increasing the breaking speed by using an arc breaking device 17 inserting an insulating screen 18 in the breaking arc produced during the mechanical separation of jaw 4 and contact knife 7.

Figure 3:
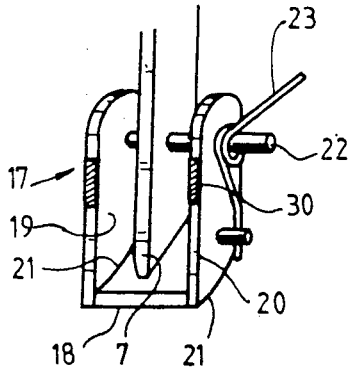
FIG. 3 is a perspective view of the arc breaking device used in the combined device shown in FIGS. 1 and 2.

In the example shown in FIGS. 1, 2 and 3, the arc breaking device 17 is formed from a pivoting screen holding structure comprising two parallel flanges 19, 20 having at least two coaxial circular edge portions 21 connected together by a curved isolating screen 18, fixed to or integrally molded with the assembly of the structure.

These two flanges 19, 20 are disposed on each side of the contact knife 7 and are mounted for rotation thereon by means of a pin 22 coaxial with said circular edge portions 21.

This screen holding structure is urged by a spring 23 which tends to cause it to pivot so as to bring screen 18 in front of the end of contact knife 7, the arrangement of the screen holding structure and the contact knife being such that, in this position, screen 18 is as close as possible to said end, taking into account the required passage clearance and manufacturing tolerances.

As can be seen in FIG. 1, when the contact formed by jaw 4 and contact knife 7 is closed, screen 18 comes into abutment against jaw 4 under the action of spring 23.

Thus, on opening, as soon as jaw 4 is mechanically separated from contact knife 7, screen 18, which is released, moves at a very high speed (due to the low inertia of the structure and the high return force exerted by spring 23) and laminates the nascent breaking arc and draws it to the breaking zone 25 where gas discharge channels 26 and possibly cooling fins 27 are provided depending on the size of the current to be broken.

Figure 4:
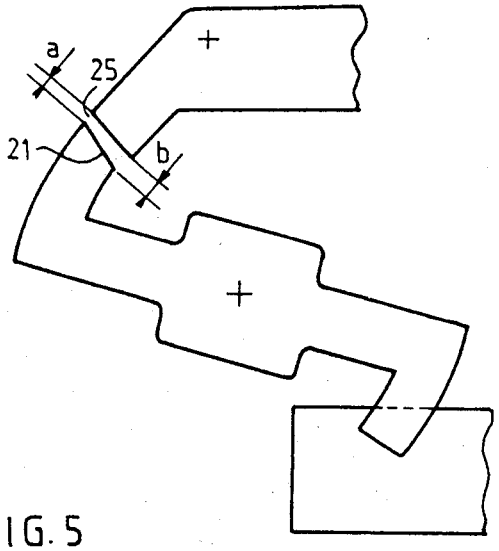
FIG. 4 shows schematically on a larger scale, the mobile assembly and the fixed contact elements of the combined device shown in FIGS. 1 and 2.

The ends of the contact knife 7 and of jaws 4 may be advantageously shaped so as to obtain an angle of relief 21 defining the starting point of the arc opposite the position where the screen is introduced (FIG. 4).

Moreover, the path travelled over by the screen carrying structure 19, 20, under the effect of spring 23, is limited by stops 29 fixed to case 10, situated to the rear far from the arc formation zone and stops 30 fixed to flanges 19, 20. These stops 29, 30 may be advantageously equipped with shock absorbers so as to avoid bouncing as much as possible.

The breaking speeds obtained (arc time $\leqq$ 2 ms,) mean that the mechanical separation of the isolating contact (jaw 5, contact knife 8) whose opening times are long (greater than 5 ms ) will always occur after electric cut-off (jaw 4, contact knife 7), so without risk of pollution of the isolating zone inside case 10.

In the example shown in FIGS. 1 and 2, case 10 comprises a transparent window 31 opposite the isolating contact formed by jaw 5 and contact knife 8, so as to be able to see the open or closed state of this contact.

Once the mechanical separation of jaw 4 and contact knife 7 has occurred screen 18 comes in front of contact knife 7 and thus prevents reengagement of these two parts.

So it is necessary to provide a resetting device causing retraction of the screen before jaw 4 can be engaged on the contact knife 7.

Figure 5:
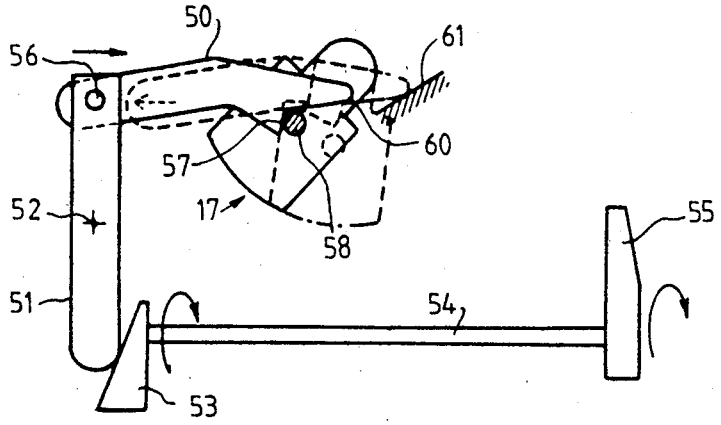
FIG. 5 is a diagram of a resetting device in the arc breaking device shown in FIG. 3.

FIG. 5 therefore illustrates one embodiment of such a resetting device. This device comprises more particularly a resetting lever 50 pivotally mounted at the end of a drive lever 51 which pivots about a central pin 52 and is urged by a cam 53 driven by a rotary shaft 54 having an operating handle 55 at its end.

The end of resetting lever 50 situated opposite pivot 56 on the drive lever 51 comprises:

on the one hand, a first stop surface 57 intended to engage with a stud 58 fixed to the screen holding structure so as to push said structure back against the action of spring 23, during the resetting phase, on the other hand, a second nose-shaped stop surface 60 intended to cooperate with a fixed cam surface 61 in the form of a bearing surface, for causing, at the end of resetting, resetting lever 50 to pivot which releases the stop surface 57 from stud 58 and thus frees the screen holding structure.

The shaft 3 for driving the mobile assembly 1 of the combined isolating switch-circuit breaker may be advantageously coupled to the rotary shaft 54 so as to obtain the following operating sequence:

CLOSURE

From the open position of the combined device shown in FIG. 2, over a first part of the rotational travel path of the operating handle 55, cam 53 pushes the drive lever 51 back and causes it to pivot, whereas the resetting lever 50 pushes back the screen holding structure through the action of stop 57 which engages on stud 58. During this first travel path, the mobile assembly 1 of the combined device is not rotated. During a second part of the rotary travel of handle 55, mobile assembly 1 of the combined device is rotated, whereas the screen holding structure 18, 19, 20 finishes its retracting movement so as to free the passage for jaw 4. After jaw 5 is engaged on the contact knife 8 of the isolating contact, jaw 4 then comes into engagement on the contact knife 7 of the circuit breaking contact after a third part of the rotational travel of handle 55.

In the last part of the closure travel of handle 55, the resetting lever 50 is raised by the action of the abutment surface 61 on the cam surface 60 and releases the screen holding structure 18, 19, 20 which thus comes into abutment and is retained against jaw 4 then engaged on the contact knife 7.

OPENING

Opening is provided by reverse rotation of the operating lever 55, which causes first of all the mechanical separation of the contact knife 7 and jaw 4. As soon as this mechanical separation has been obtained, the screen holding structure 18, 19, 20 moves at high speed and comes into the position shown in FIG. 2. During the next phase, separation of jaw 5 and contact knife 8 occurs and the mobile assembly 1 reaches the open position shown in FIG. 2.

Figure 8:
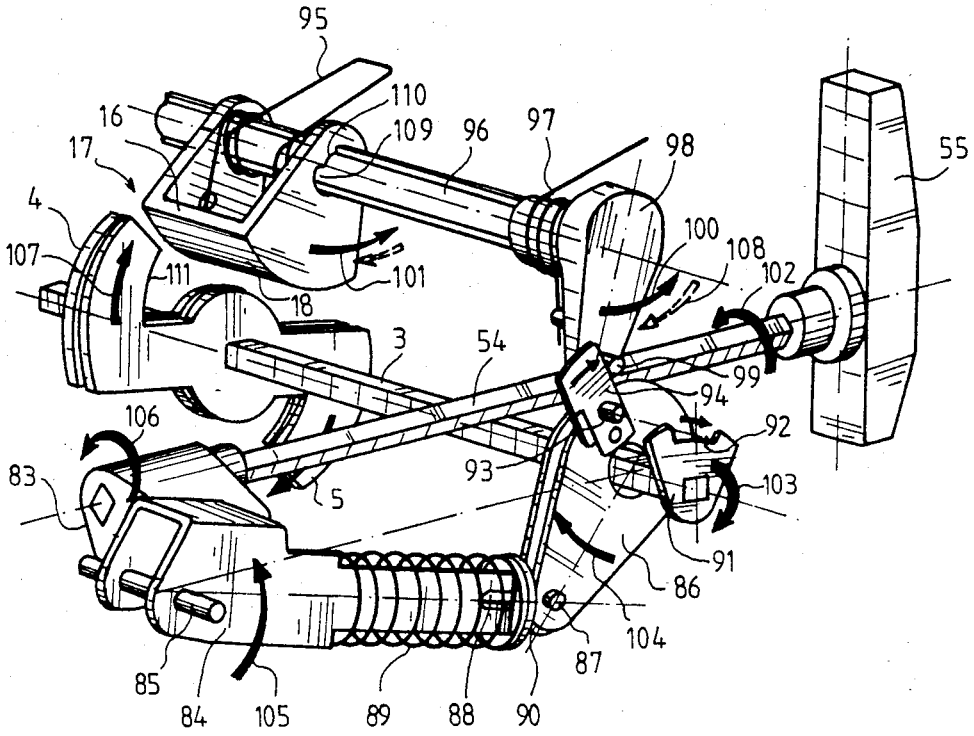
FIG. 8 is a schematical perspective view illustrating a variant of an actuating mechanism for a combined isolating switch-circuit breaker with rotary mobile assembly.

Coupling of the drive shaft 3 of the mobile assembly of the combined isolating switch-contact breaker with the rotary shaft 54 so as to obtain such an operating sequence may be provided for example as shown in FIG. 8.

In this Figure, drive shaft 54, comprises, at its end, a lever 83 having a finger (not shown) which engages with the drive rod 84 of a dead point rocking-lever pivoting on a pivot 85. This drive rod 84 comprises, in its end opposite pin 85, an axial oblong recess 88 through which passes a pin 87 fixed to a cam 86 mounted for rotation about drive shaft 3 of the mobile assembly 4, 5 of the isolating switch-circuit breaker. Spring 89, disposed coaxially to rod 84 and retained on one side by this latter, bears on the end surface 90 of cam 86. Driving of shaft 3 from the cam is provided through a piece 91 integral with shaft 3 and having an indentation 92 through which passes a stud 93 fixed to a lug 94 securely fixed to cam 86.

In addition, the screen holding structure 18 is mounted, with a given angular clearance and with spring return 95, on a splined shaft 96 urged by a return spring 97 and having at its end a lever 98 with a finger 99 engaging with lug 94.

In this Figure, the thick line arrows 100 to 107 show the direction of movement during closure of the combined device.

Thus, through the drive shaft 54, control handle 55 drives lever 83. The finger fixed to this lever raises the drive rod 84 of the dead point rocking-lever which pivots about pivot 85. Rod 84 causes cam 86 to rotate by acting on pin 87 which slides in the oblong recess 88. During this rotation, spring 89 is compressed by the relative movement of end 90 of cam 86 with respect to rod 84 and then stores the energy until pins 85, 87 and shaft 3 are aligned.

Lug 94, integrally locked with cam 86, through finger 99 and lever 98 drives the splined shaft 96 controlling the screen holding structure 17, the return spring 97 driving said shaft 96 in the direction of arrow 108 (shown with a broken line). With the closure travel finished, finger 99 passes above lug 94 so that, from this momement, lever 98 is no longer driven and comes back in the direction of arrow 108, which results in changing the play 109 between the driving part 110 of the screen holding structure 17 and the edges of the splines of shaft 96 from one side to the other since, in this closure position, screen 18 comes into abutment and is held against the internal part 111 of the mobile contact breaking element 4 (because finger 99 is no longer held by lug 94).

It should be noted that the combination of return spring 95 and the angular clearance 109 provided between the screen holding structure 17 and the splined shaft 96, which may advantageously correspond to the pivoting travel of the screen holding structure 18, allows individualized operation of screens 17 guaranteeing movement of screen 18 as soon as the corresponding circuit breaking contact effectively opens. This result could not be obtained, in the case of a multi-pole combined device, if a control were used common to all the screens (for example, if the screen holding structures 17 were mounted fixedly and without play on shaft 96), because of the manufacturing tolerances.

Moreover, it should be recalled that cam 86 rotates freely on the drive shaft 3 of the mobile assembly of the combined device and that the indented piece 91 is interlocked with said shaft.

Thus, in the first part of the movement of cam 86, stud 93 firmly secured to lug 94 is free in the indentation 92 of piece 91. Towards the dead position of the rocking-lever (alignment of pins 85, 87 and shaft 3) screen 18 is freed from the intercontact space and stud 93 does not yet drive piece 91. When the rocking lever passes beyond its dead point, spring 89 releases the energy which it has stored and causes cam 86 to rotate, so that stud 93 abruptly drives the indented piece 91, thus providing clean closure of the contacts all the more so since, by construction, it is possible to provide an imbalance of the rocking lever so as to provide a greater closure force since, with the arrangements of the invention, a rapid opening movement is not required.

Of course, the combined isolating switch-circuit breaker of the invention may be multi-pole and comprise several mobile assemblies 1 mounted for rotation on the same drive shaft, each of these mobile assemblies then being associated with two fixed contact elements.

Figure 6:
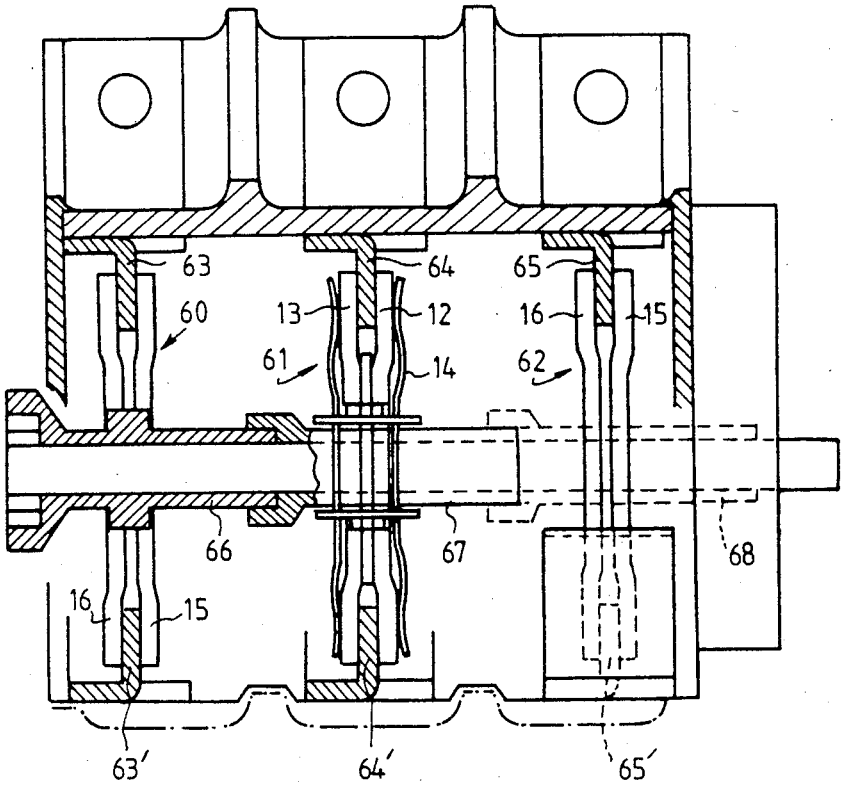
FIG. 6 is an axial section of a combined three-pole isolating switch-circuit breaker.

By way of example, FIG. 6 illustrates one embodiment of a combined isolating switch-circuit breaker comprising three circuit breaking and isolating assemblies each comprising a rotary assembly 60, 61, 62 and two fixed contacts 63–63', 64–64', 65–65' such as shown in FIGS. 1 and 2. In this example assemblies 60, 61, 62 are mounted on respective drive shaft sections 66, 67, 68 assembled together end to end. With this arrangement, the number of circuit breaking and isolating assemblies may advantageously be modified so as to pass for example from a twin pole assembly to a three pole assembly.

Figure 7:
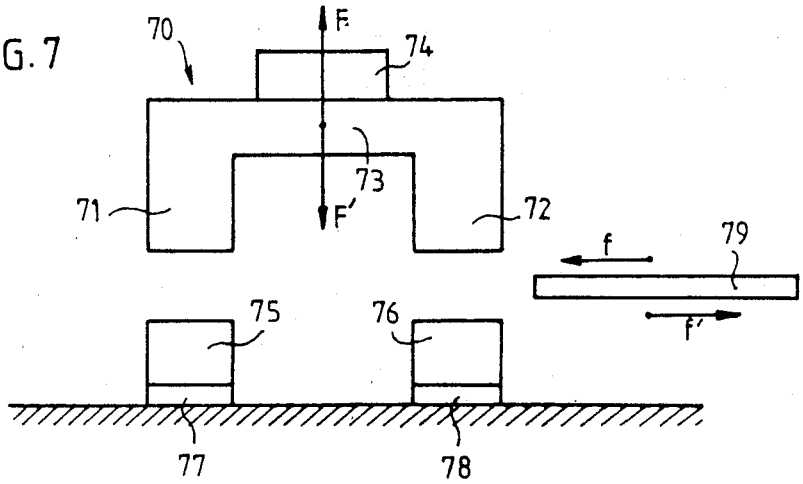
FIG. 7 is a schematical representation of a combined isolating switch-circuit breaker comprising a mobile assembly in translation.

As mentioned above, the invention is not limited to a combined isolating switch-circuit breaker comprising a rotary mobile assembly. In fact, this assembly could just as well be movable in translation, for example as shown in FIG. 7.

In this Figure, the combined device comprises a U shaped assembly 70 with wings 71, 72 of unequal length, which may be moved in translation perpendicularly to its web 73 (arrows F, F') for example by means of a handle 74.

Opposite the ends of wings 71, 72 of the mobile assembly are disposed two fixed contact elements 75, 76 connected to power supply leads 77, 78.

Wings 71, 72 of the mobile assembly 70 may be formed from contact knives and, in this case, the fixed contact elements 75, 76 may comprise jaws of a type similar to those described above.

Conversely, the fixed contact elements 75, 76 could comprise respective contact knives, the wings 71, 72 of the mobile assembly 70 then comprising jaws.

Similarly, the circuit breaking contact formed by wing 72 (the shortest) and the fixed contact element 76 may be equipped with a mobile isolating screen 79 movable in translation as shown by arrows F, F'.

Figure 9:
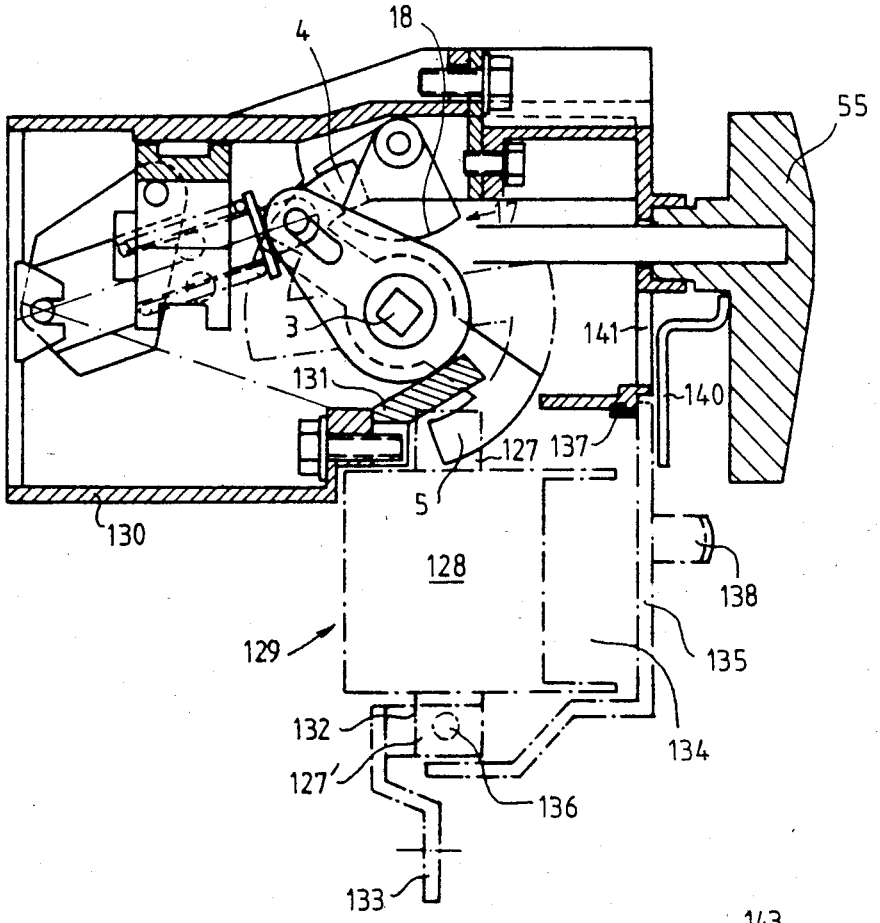
FIG. 9 is a schematical section of a combined isolating switch-circuit breaker with rotary mobile assembly equipped with a fuse holder.

FIG. 9 shows a combined circuit breaker-fuse holder isolating switch in accordance with the invention.

This combined device thus comprises, in the way already described, a rotary mobile assembly comprising at least one contact breaking jaw 4 and an isolating contact jaw 5, this assembly being rotated by drive shaft 3. Similarly to the foregoing, the circuit breaking contact is equipped with an arc breaking device with pivoting screen 18. Operation of the mobile assembly and of the arc breaking device is provided by means of an operating handle 55 and a drive shaft 54 associated with a mechanical system of the type shown in FIG. 8.

However, in this example, the contact knife of the fixed isolating contact consists of one of the two knives 127, 127' of a knife fuse 128 removably mounted in a fuse holder 129 integral with case 130 of the combined isolating switch-circuit breaker.

This fuse holder 129 comprises more particularly a positioning piece 131 in which the knife 127 of fuse 128 is partially engaged and a fixed jaw 132 connected to the starting terminal 133 of the combined device and in which is engaged the knife 127' of fuse 128. Fuse 128 is held in position at the level of its body by a support element 134 integral with a pivoting fuse holder cover 135 pivotably mounted about a pivot 136 and held in the closed position by snap fit means 137. This cover 135 further comprises a handle 138 for opening the fuse holder 129 with simultaneous removal of the fuses 128.

Furthermore, a locking bar 140 actuated by the operating handle 55 is provided so that such opening is only made possible if the circuit breaker-isolating switch is in an open position, in which position handle 55 is at 90° from the position shown and the locking bar 140, driven by handle 55, is in a retracted position. The transparent window 141 provided in case 130 above cover 135 makes opening of the contact elements of the isolating switch part of the combined device totally visible, so as to be able to confirm the apparent opening shown by the position of the control handle 55.

Figure 10:
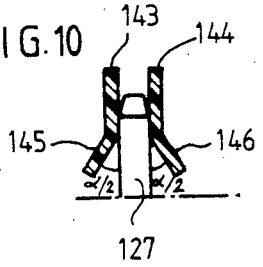
FIG. 10 is a detailed view of the piece for positioning the fuses inside the fuse holder used in the combined device shown in FIG. 2.

FIG. 10 shows the detail of the function of the positioning piece 131 of fuse 128. This positioning piece comprises two jaws 143, 144 made from an insulating material having resilient and anti friction properties, and comprising two lips 145, 146 forming an angle $\alpha$ and of sufficient length for guiding knife 127 of fuse 128 at the beginning of its introduction. These two jaws 143, 144 which, at rest, are applied against each other are then moved apart from each other by knife 127 during introduction thereof. At the end of positioning, jaws 143, 144 nip a small part of knife 127 in a zone situated so that jaw 5 of the isolating contact can move freely and come into engagement without any hindrance on the remaining part of knife 127 which then forms the fixed part of isolating contact element.

We claim:

1. In a combined isolating switch-circuit breaker comprising at least one fixed contact breaking element, a fixed isolating element, at least one mobile assembly comprising a mobile contact breaking element electrically connected to a mobile isolating contact element, said two mobile contact elements being adapted for cooperation respectively with said two fixed contact elements, and means for moving the mobile assembly between an open position in which said fixed contact elements are moved apart from said mobile contact elements and a closed position in which said fixed contact elements are in electric contact with the corresponding mobile contact elements, the arrangement of said mobile contact elements with respect to said fixed contact elements as well as the nature of the movements of said mobile assembly being provided so that, when passing from the open position to the closed position said fixed isolating contact element is electrically connected to said mobile isolating contact element before the electric contact between said fixed contact breaking element and said mobile contact breaking element is established and conversely, when passing from the closed position to the open position said fixed contact breaking element is released from said mobile contact breaking element before disconnection of said fixed isolating contact element and said mobile isolating contact element, the improvement consisting in the provision of means for inserting an isolating screen between said mobile and fixed contact breaking elements in the moment following the mechanical separation of these contact elements, said insertion means comprising a setting member with accumulation of potential energy adapted for moving the screen away from the passage zone of said mobile contact breaking element, during the closure travel of the mobile assembly with, simultaneously, accumulation of potential energy and tripping means adapted for releasing this potential energy, during the opening travel of said mobile assembly, when said separation occurs so as to effect said insertion at a speed independent of that of the mobile assembly.

2. The combined device as claimed in claim 1, wherein said insertion means are adapted for effecting insertion of said isolating screen on the side opposite the point where the arc begins.

3. The combined device as claimed in claim 1, wherein said mobile and fixed contact breaking elements are shaped so as to define a point at which the arc begins, opposite the position where introduction of the screen takes place.

4. The combined device as claimed in claim 1, wherein said fixed contact elements consist of contact knives and said mobile contact elements comprise a resiliently urged jaw in which said contact knife is engaged.

5. The combined device as claimed in claim 4, wherein the contact knife and the jaw of said contact breaking elements form a relief angle defining the point at which the arc begins opposite the position where introduction of the screen takes place.

6. The combined device as claimed in claim 1, wherein said mobile and fixed contact breaking elements are shaped so as to define a breaking zone in which are disposed cooling fins and/or gas discharge channels.

7. The combined device as claimed in claim 1, comprising means for moving said mobile assembly which cooperate with the means for inserting said isolating screen so as to obtain a closure sequence comprising successively retraction of said screen, movement of the mobile assembly at the end of which interconnection of the isolating contact elements then of the contact breaking elements takes place and setting of the isolating screen, and an opening sequence comprising disconnection of the contact breaking elements, rapid insertion of said isolating screen at a speed independent of the opening movement as soon as these contact breaking elements are separated mechanically and disconnection of the isolating contact elements.

8. The combined device as claimed in claim 1, wherein, in the set position, said isolating screen is held in abutment against said mobile assembly.

9. The combined device as claimed in claim 1, wherein said mobile assembly is caused to rotate and comprises a conducting blade mounted at its central portion on a transverse drive shaft and having at its end two respective curved jaws orientated in opposite directions with respect to each other and extending concentrically, on each side of said blade, and wherein said fixed contact elements form contact knives offset with respect to each other.

10. The combined device as claimed in claim 1, wherein said screen has a curved shape and is integral with a screen holding structure formed from two parallel screen holding flanges disposed on each side of said fixed contact breaking element, said two flanges being mounted for rotation and urged by resilient means tending to bring said screen opposite said fixed contact breaking element.

11. The combined device as claimed in claim 9, further comprising means for resetting said isolating screen, said means comprising a resetting lever pivotably mounted at the end of a drive lever itself pivotably mounted and urged by a cam driven by a rotary shaft whose rotary movement is related to the rotary movement of said mobile assembly and wherein the end of said resetting lever situated on the side opposite its pivot comprises a first stop surface cooperating with a stud fixed to the screen holding structure for pushing this latter back against the action of said resilient means during the resetting phase and a second abutment surface cooperating with a fixed cam surface adapted for causing, at the end of resetting, pivoting of said resetting lever which frees the first abutment surface from said stud and thus frees the screen holding structure.

12. The combined device as claimed in claim 9, comprising an actuating mechanism having:

a drive shaft whose rotation is controlled by an operating member, a dead point rocking lever comprising an oscillating rod pivoting on a pin and comprising an oblong recess, a first mechanical coupling means for transforming the rotational movement of the drive shaft into an oscillating movement of the oscillating rod, a cam mounted for rotation about said drive shaft of the mobile assembly of the isolating switchcircuit breaker and having a pin passing through said oblong recess, a first spring mounted on said rod and bearing on said cam, a second mechanical coupling means for rotating said drive shaft, with a first predetermined play, from the rotational movement of said cam, a resetting shaft on which said screen holding structure is mounted with a second predetermined angular play, a second spring exerting a force on said screen holding structure, a third spring exerting a force on said resetting shaft, a third mechanical coupling means for rotating said resetting shaft, with release at the end of travel from the rotational movement of said cam.

13. The combined device as claimed in claim 12, wherein said first mechanical coupling means comprises a lever secured to said drive shaft and having a finger bearing on said oscillating rod.

14. The combined device as claimed in claim 12, wherein said second mechanical coupling means comprises a piece integral with said shaft and having an indentation, and a stud secured to said cam passing in said indentation.

15. The combined device as claimed in claim 12, wherein said third mechanical coupling means comprises a lever, mounted on said resetting lever and comprising a finger cooperating with a lug integral with said cam.

16. The combined device as claimed in claim 12, wherein said second angular play corresponds to the pivoting travel of said screen holding structure.

17. The combined device as claimed in claim 12, wherein, on said resetting shaft, several screen holding structures associated with several isolating switch-circuit breaker assemblies are mounted with play, with return by independent spring, so as to obtain individualized operation of said screen holding structure.

18. The combined device as claimed in claim 1, further comprising a removable knife fuse one of whose knives forms the contact knife of said fixed isolating contact.

19. The combined device as claimed in claim 18, comprising a fuse holder in which said fuse is disposed, said fuse holder comprising a positioning piece in which the knife of the fuse serving as contact knife for the fixed isolating contact is partially engaged, and a fixed jaw connected to the starting terminal of the combined device and in which the second knife of the fuse is engaged.

20. The combined device as claimed in claim 19, wherein said positioning piece for the fuse comprises two jaws made from an insulating material having resilient properties and comprising two lips between which the knife of the fuse is partially engaged.

21. The combined device as claimed in claim 20, wherein said two jaws comprise two lips forming a predetermined angle.

22. The combined device as claimed in claim 1, wherein said mobile assembly is moved in translation.

* * * * *